US007679484B2

(12) United States Patent
Onoda et al.

(10) Patent No.: US 7,679,484 B2
(45) Date of Patent: Mar. 16, 2010

(54) FUSIBLE LINK UNIT

(75) Inventors: Shinya Onoda, Shizuoka (JP); Toshiharu Kudo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 246 days.

(21) Appl. No.: 11/783,147

(22) Filed: Apr. 6, 2007

(65) Prior Publication Data

US 2007/0268107 A1 Nov. 22, 2007

(30) Foreign Application Priority Data

May 19, 2006 (JP) ..... 2006-139997

(51) Int. Cl.
*H01H 85/30* (2006.01)
*H01H 85/02* (2006.01)

(52) U.S. Cl. ..... 337/206; 337/198; 337/241; 337/242

(58) Field of Classification Search ..... 337/198, 337/206, 241, 242
See application file for complete search history.

(56) References Cited

U.S. PATENT DOCUMENTS 1,902,613 A * 3/1933 Blumberg ..... 337/297
4,035,754 A * 7/1977 Kleinbohl ..... 337/206
5,854,583 A * 12/1998 Falchetti ..... 337/290
5,889,458 A * 3/1999 Nakamura ..... 337/159
6,566,599 B2 * 5/2003 Sumida et al. ..... 174/50
7,119,652 B2 * 10/2006 Umeda ..... 337/282
7,420,453 B2 * 9/2008 Matsumura et al. ..... 337/295
2005/0116806 A1 * 6/2005 Iwata ..... 337/188

FOREIGN PATENT DOCUMENTS

GB 2178913 A * 2/1987
JP 2002-358870 12/2002
JP 2002358870 A * 12/2002

* cited by examiner

*Primary Examiner*—Anatoly Vortman
(74) *Attorney, Agent, or Firm*—Kratz, Quintos & Hanson, LLP

(57) ABSTRACT

A fusible link unit includes a housing and two fuse circuit bodies overlapped with each other and received in the housing in a thickness direction of the housing. A coupling plate and terminals connected to each other via fuse elements integrally forms the fuse circuit body. An opening is formed on an outer wall of the housing. The housing includes a cover made of transparent material and having a U-shaped section for covering the opening. The cover integrally includes a projection projecting to an inside of the housing on a sidewall of the cover. The projection includes a reflecting wall sloping on the sidewall in a thickness direction of the housing 7.

7 Claims, 8 Drawing Sheets

FUSIBLE LINK UNIT

CROSS REFERENCE TO RELATED APPLICATIONS

This application is on the basis of Japanese Patent Application No. 2006-139997, the contents of which are hereby incorporated by reference.

BACKGROUND OF THE INVENTION

1. Field of the Invention

The present invention relates to a fusible link unit having a fuse circuit body integrally made of metal plate, and a housing.

2. Description of the Related Art

Conventionally, in a vehicle, various fusible link units are used for preventing an excessive current from being supplied to various electronic components mounted on the vehicle (for example, see Japanese Published Patent Application No. 2002-358870).

The fusible link unit includes a fuse circuit body having a coupling plate and a plurality of terminals connected to the coupled plate via fuse elements, and a housing receiving the fuse circuit body.

The coupled plate includes a plate part and a terminal piece curved at right angle and extended from one edge of the plate part. The coupled plate is formed in a U-shape from a side view. The terminal piece has a connecting part for connecting to electric source of a battery, a generator, or the like.

The fuse element is connected to the other edge of the plate part, and arranged in a same plane with the plate part. A plurality of fuse elements is arranged in parallel and leaves spaces between each other. A plurality of terminals is extended from the other side of the fuse elements, namely, extended from a far side of the coupled plate. The terminals are arranged in parallel and leave spaces between each other. The various electronic components are connected to the terminals. The housing is made of insulating synthetic resin, and formed in an oblong box shape.

The fusible link unit is assembled by receiving the fuse circuit body in the housing. Then, the electric source is connected to the coupling plate of the fuse circuit body, and the electronic components are connected to the terminals. Thus, the fusible link unit is mounted on a vehicle.

According to the above reference, the fusible link unit has a checking window made of transparent or semitransparent synthetic resin and formed on an outer wall of the housing. The fuse elements are arranged in the housing near the checking window so that blowouts of the fuse elements can be seen from an outside of the housing.

However, according to the fusible link unit described on the above reference, when the unit is disposed on a dark place disposed on a backside of an engine room or an instrument panel of a vehicle body, the window may not always be seen from a top of the window, or an inside of the checking window is too dark to see.

Further, when a plurality of the fuse circuit bodies are overlapped with each other in a direction crossing the checking window, the coupling plate disposed away from the checking window is hidden behind the fuse elements disposed near the checking window, so that the fuse elements disposed away from the checking window is hard to be seen. Thus, in the conventional fusible link unit described above, it is hard to check whether the fuse elements are blown out or not.

Accordingly, an object of the present invention is to provide a fusible link unit that allows fuse elements to be seen easily.

SUMMARY OF THE INVENTION

In order to attain the object, according to the present invention, there is provided a fusible link unit including:

a fuse circuit body having a plurality of terminals connected to a coupling plate via fuse elements;

a housing having an opening at an outer wall and receiving the fuse circuit body;

a reflecting wall disposed in the housing for reflecting light transmitted from the opening into the housing toward the fuse elements.

Preferably, the reflecting wall is a part of the coupling plate, and formed in a shape of a concavely curved surface in a direction leaving the terminal with respect to the coupling plate.

Preferably, the reflecting wall is a part of the coupling plate, and formed in a shape of a convexly curved surface in a direction approaching the terminals with respect to the coupling plate.

Preferably, the reflecting wall is connected to the fuse elements in a direction crossing the fuse elements.

Preferably, the fusible link unit is made of a transparent material, and includes a cover for covering the opening of the housing.

These and other objects, features, and advantages of the present invention will become more apparent upon reading of the following detailed description along with the accompanied drawings.

DETAILED DESCRIPTION OF THE PREFERRED EMBODIMENTS

First Embodiment

A fusible link unit 1A according to a first embodiment of the present invention will be explained with reference to FIGS. 1 to 3.

Figure 2:
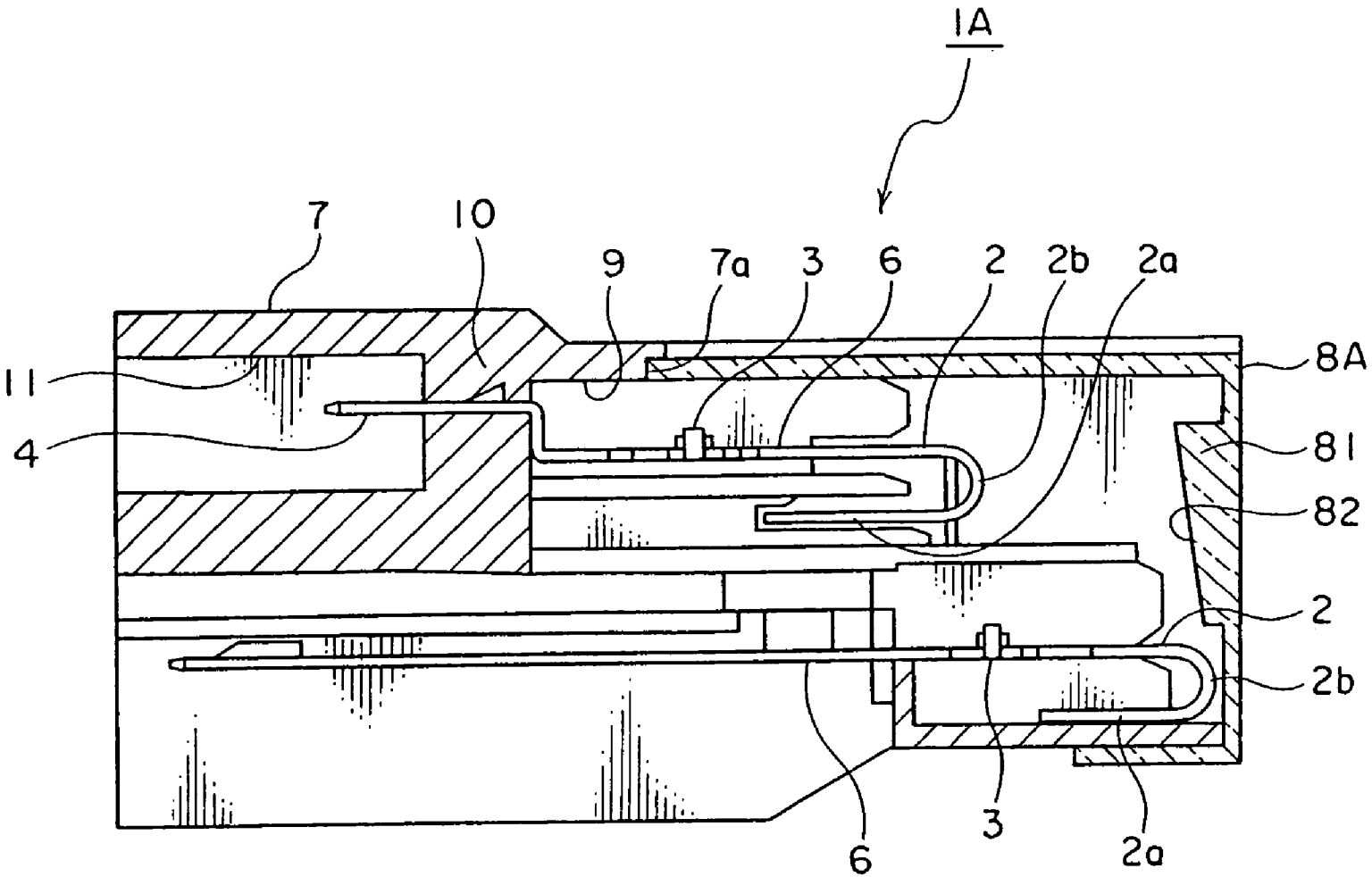
FIG. 2 is a sectional view taken on line II-II in FIG. 1.

As shown in FIG. 2, the fusible link unit 1A includes a coupling plate 2, fuse elements 3 connected to one side of the coupling plate 2, and terminals 4 connected to the fuse elements 3. The fusible link unit 1A also includes a fuse circuit body 6 formed by the terminals 4 connected to the coupling plate 2 via the fuse elements 3, and a housing 7 for receiving the fuse circuit body 6.

Figure 1:
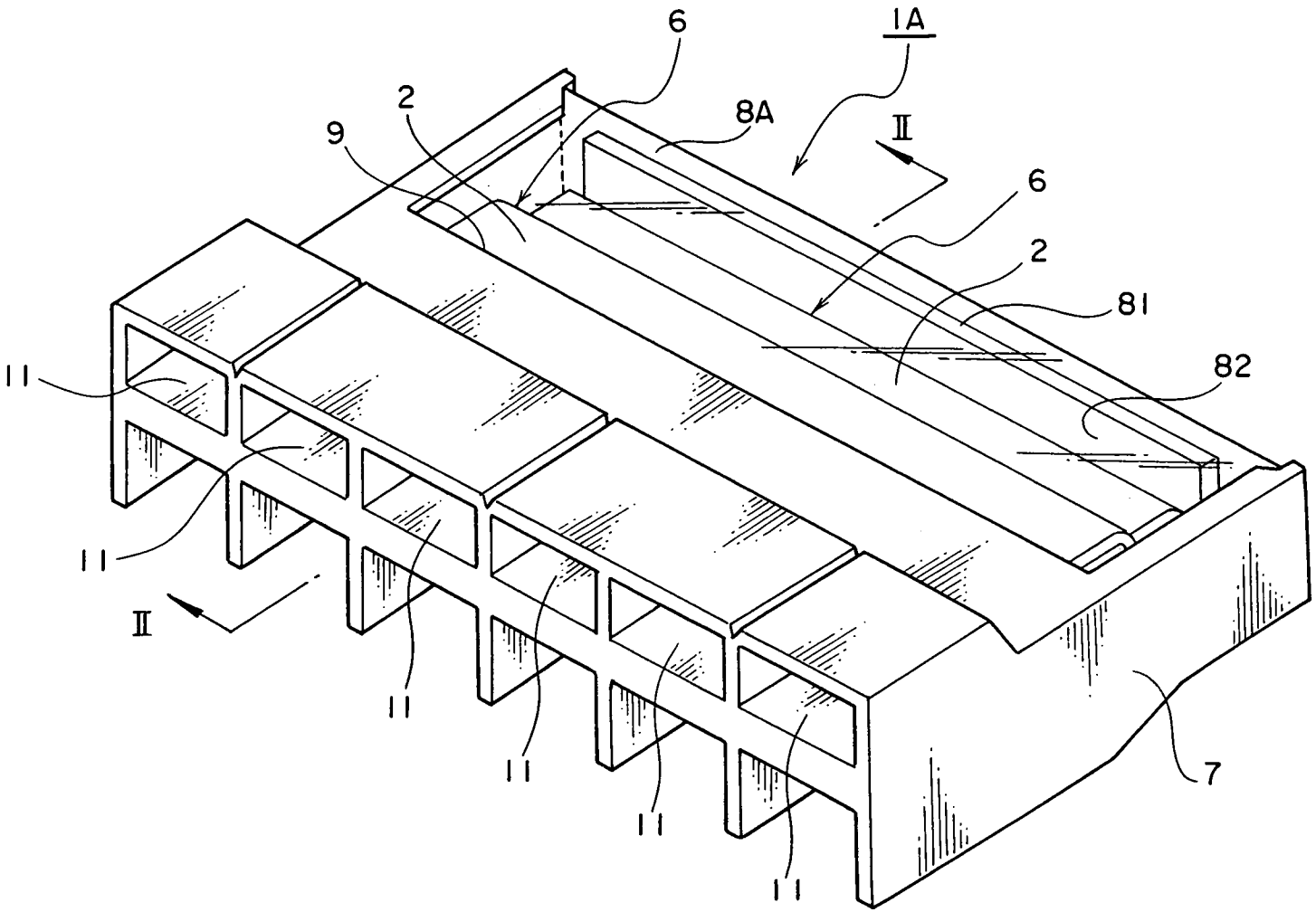
FIG. 1 is a perspective view showing a fusible link unit according to a first embodiment of the present invention.

As shown in FIGS. 1 and 2, the housing 7 is made of insulating synthetic resin, and formed in a substantially box shape. An opening 7*a* for inserting the fuse circuit body 6 into the housing 7 is formed on an upper wall of the housing.

In the housing 7, a circuit receiving chamber 9 is formed extending from the opening 7*a*. A terminal support 10 and a connector housing 11 are formed extending from the circuit receiving chamber 9 at a side thereof. As shown in FIG. 1, The terminal support 10 and the connector housing 11 are arranged in a longitudinal direction of the housing 7 opposed to the opening 7*a*.

As shown in FIG. 2, two fuse circuit bodies 6 are inserted into the housing 7 via the opening 7*a* in a transversal direction from tips of the terminals 4. Thus, the two fuse circuit bodies 6 are received in the circuit receiving chamber 9 and overlapped with each other in a thickness direction of the housing 7.

The fuse circuit body 6 is integrally formed by pressing a not-shown conductive flat plate, and composed of the coupling plate 2 and the fuse elements 3 and the terminals 4 integrally.

Figure 3:
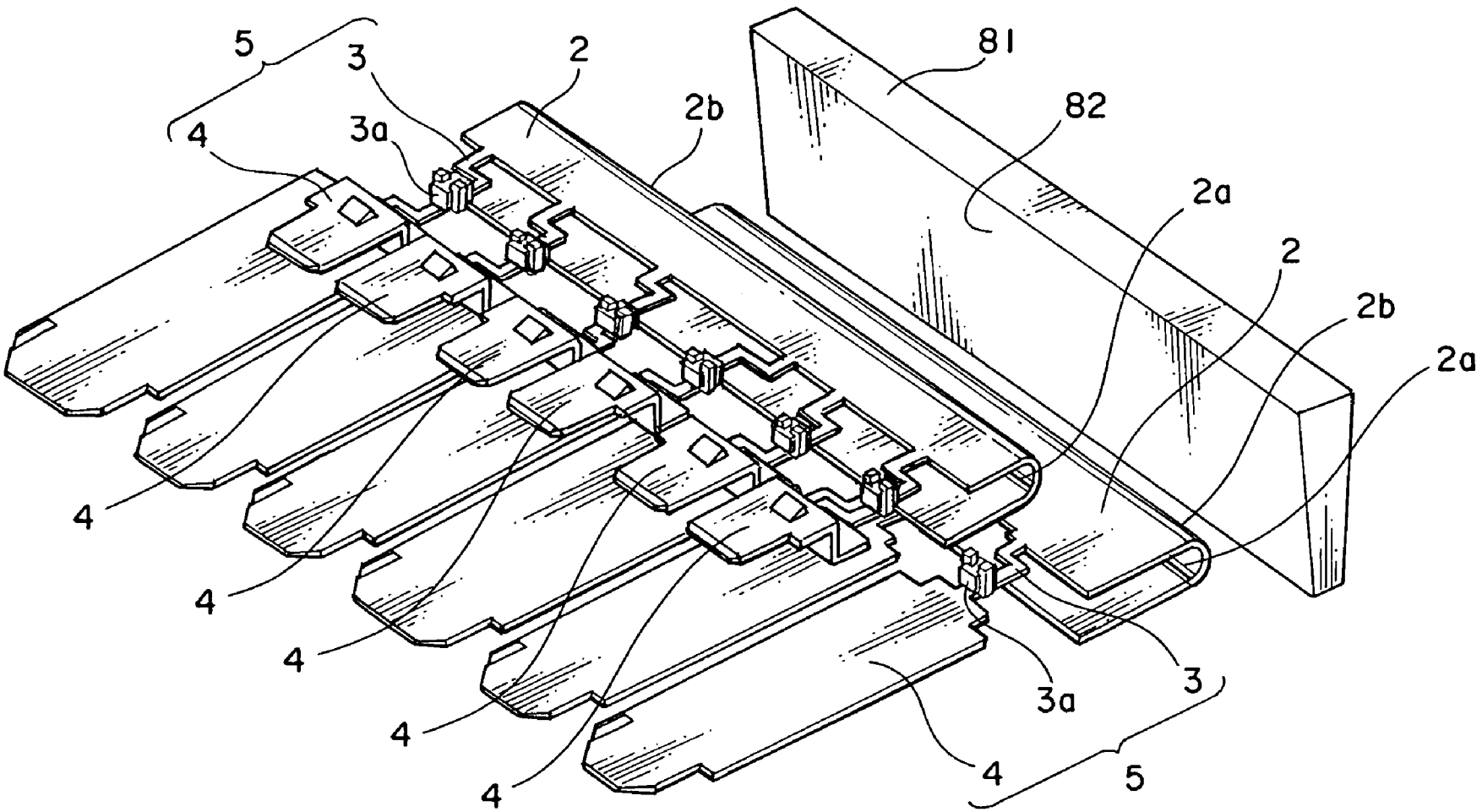
FIG. 3 is a perspective view showing a fuse circuit body of the fusible link unit shown in FIG. 2.

As shown in FIG. 3, the coupling plate 2 is formed as a common terminal to the fuse elements 3 and the terminals 4, and as a bus bar plate at a ground side. The coupling plate 2 includes a side part 2*a* which is not connected to the fuse elements 3 and the terminals 4, and a U-shaped part 2*b* extended from the side part 2*a* in the transversal direction of the coupling plate 2.

The fuse elements 3 is respectively connected to one side of the coupling plate 2, and formed in a narrow crank shape. In the middle of the crank, a low-melting metal 3*a* is crimped and fixed. When a current more than a specific value flows, the fuse elements 3 having the low-melting metal 3*a* is blown out.

The terminals 4 are connected to the fuse elements 3. One fuse element unit 5 is composed of a pair of the fuse element 3 and the terminal 4. According to the first embodiment, as shown in FIG. 3, a plurality of the fuse element units 5 is connected to one side of the coupling plate 2 in a longitudinal direction thereof to form the one fuse circuit body 6.

As shown in FIG. 2, a cover 8A is attached to the opening 7*a* on the housing 7. The cover 8A is made of transparent material, and formed in a U-section for coveting the opening 7*a*. The cover 8A allows an inside of the housing 7 covered by the cover 8A to be seen from an outside of the housing 7.

A projection 81 projected toward the inside of the housing 7 is formed on a side wall of the cover 8A parallel to the thickness direction of the housing 7.

The projection 81 is formed integrally with the cover 8A. As shown in FIG. 2, the projection 81 has a sloping wall 82 sloping in the thickness direction of the housing 7, one end of which is in a direction away from a sidewall of the cover 8A, the other end of which is in a direction approaching the sidewall of the cover 8A.

The sloping wall 82 is formed on the sidewall of the cover 8A in the housing 7. The sloping wall 82 is a mirror surface made by metal plating or the like. The sloping wall 82 reflects light transmitted from the opening 7*a* to the housing 7 toward the fuse elements 3. The sloping wall 82 is a reflecting wall in claims.

In the fusible link unit 1A, the terminals 4 of the fuse circuit body 6 are firstly inserted into the housing 7 from the opening 7*a* in the transversal direction of the housing 7. The inserted fuse circuit body 6 is received in the circuit receiving chamber 9, and the terminals 4 are received in the terminal support 10 and the connector housing 11 via the circuit receiving chamber 9.

Not-shown cables are connected to the terminals 4 disposed on the terminal support 10 via terminal fittings.

Not-shown various electronic components are connected to the cables. By connecting the cables to the fuse circuit body 6, a plurality of the electric components is connected to the fusible link unit 1A. Thus, the one fusible link unit 1A manages the electronic components In such a fusible link unit 1A, when an excessive current flows in an electric circuit where a battery supplies electricity to the electric components, the fuse elements 3 of the fusible link unit 1A is heated and blown out to protect the electric circuit from the excessive current.

Because the fusible link unit 1A is mounted so that the transversal direction of the housing 7 is directed horizontally in a vehicle body, the fuse elements 3 arranged in the housing 7 can be seen from a top of the housing 7 through the cover 8A. Thus, the fusible link unit 1A can be checked and maintained.

As shown in FIG. 2, the fusible link unit 1A is mounted on a vehicle so that the transversal direction of the housing 7 is directed horizontally, namely, so-called transversal-mounted fusible link unit 1A. Therefore, the two fuse circuit bodies 6 received in the housing 7 are overlapped with each other horizontally in the transversal direction of the housing 7.

Further, as shown in FIG. 2, an interval between the fuse circuit bodies 6 in the housing 7 is so small that the fuse circuit bodies 6 are close to each other.

The sloping wall 82 mounted on the projection 81 reflects the light transmitted into the housing 7 via the opening 7*a* toward the fuse elements 3, so that the lower fuse circuit body 6 of the two fuse circuit bodies 6 overlapped with each other in the housing 7 is illuminated and visible.

Further, when the fuse circuit bodies 6 received in the housing 7 are seen from the top of the housing 7 via the cover 8A, the sloping wall 82 reflects a reflected image of the fuse elements 3 toward the opening 7*a*, so that the fuse elements 3 of the lower fuse circuit body 6 can be seen.

Further, the sloping wall 82 mounted on the projection 81 reflects heat emission caused by the excessive current through the fuse elements 3, so that temperature of the fuse circuit body 6 is prevented from increasing.

Further, because a surface of the sloping wall 82 is a mirror surface formed by such as metal plating, the reflected image of the fuse elements 3 reflected to the opening 7*a* is clearly visible.

In the first embodiment, the projection 81 is formed integrally with the cover 8A, however, the projection 81 may be separated from the cover 8A.

Second Embodiment

Next, a fusible link unit 1B according to a second embodiment of the present invention will be explained with reference to FIGS. 4 to 6.

Figure 4:
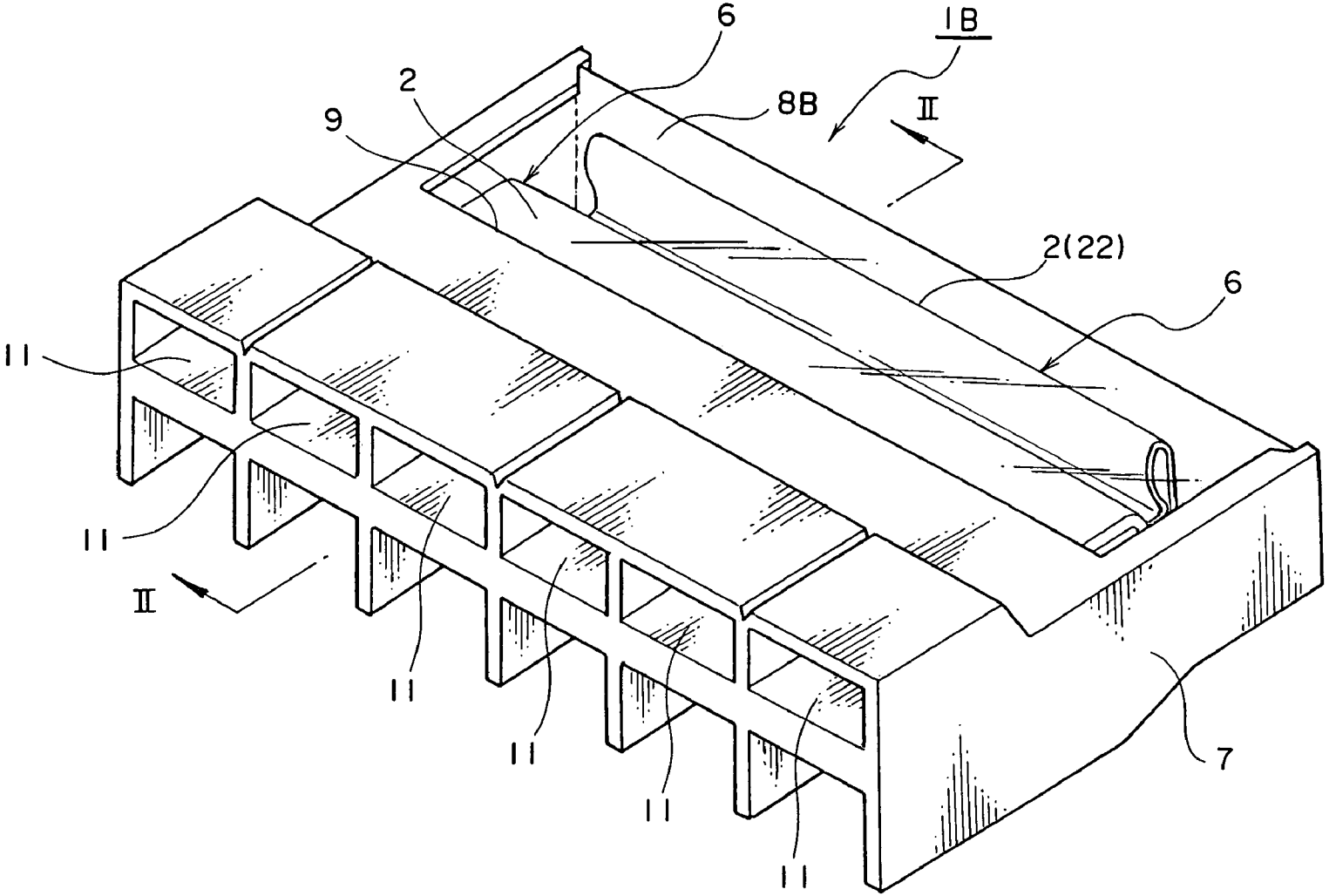
FIG. 4 is a perspective view showing a fusible link unit according to a second embodiment of the present invention.

As shown in FIG. 4, the fusible link unit 1B includes: an opening 7*a* on an outer wall; a cover 8B formed in a U-shaped section for covering the opening 7*a*; a coupling plate 2; fuse elements 3 connected to one side of the coupling plate 2; and terminals 4 connected to the fuse elements 3. A fuse circuit body 6 is formed by the terminals 4 connected to the coupling plate 2 via the fuse elements 3. The fusible link unit 1B also includes a housing 7 in which the two fuse circuit bodies 6 are overlapped with each other and received in a thickness direction of the housing 7.

Figure 5:
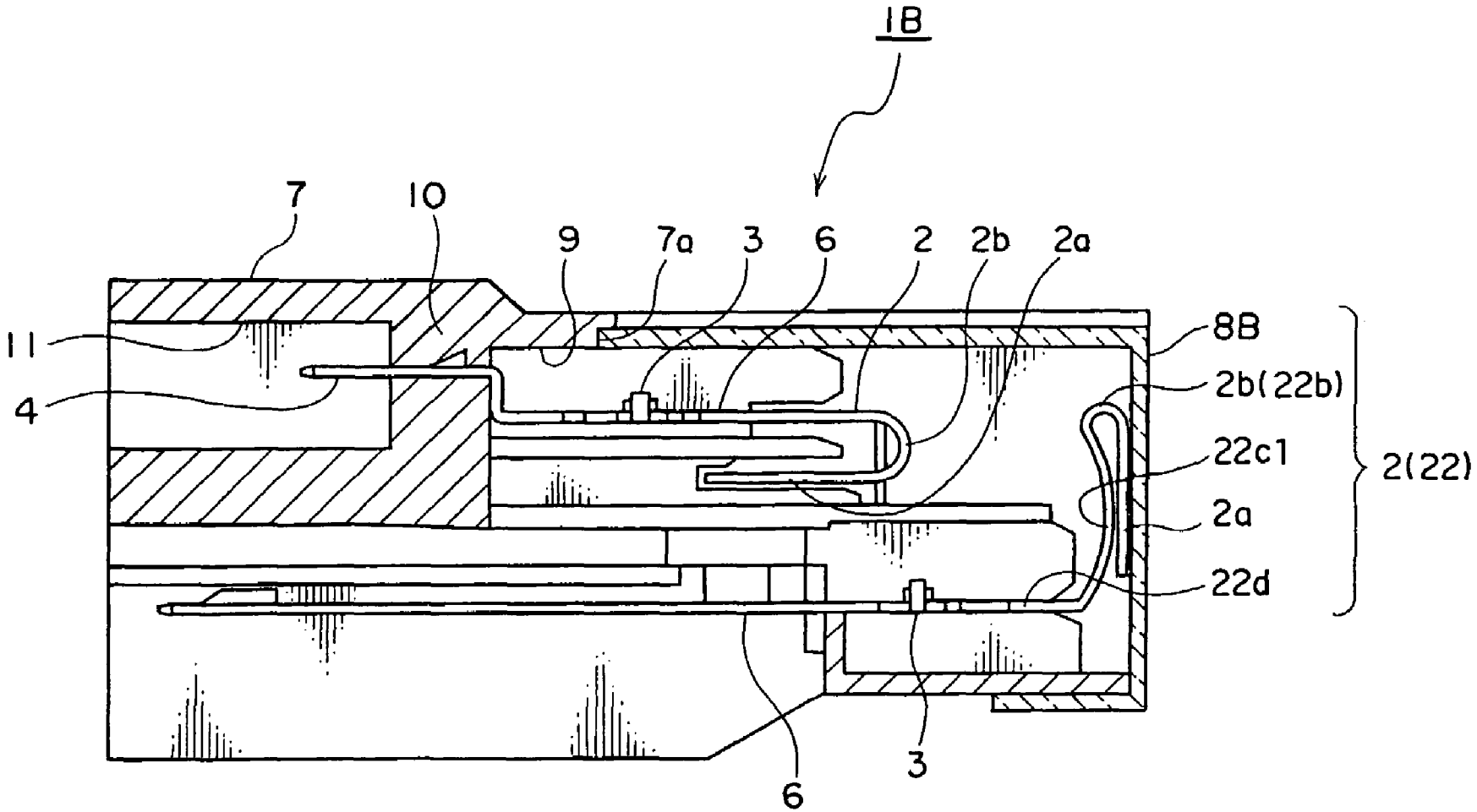
FIG. 5 is a sectional view taken on line II-II in FIG. 4.
Figure 6:
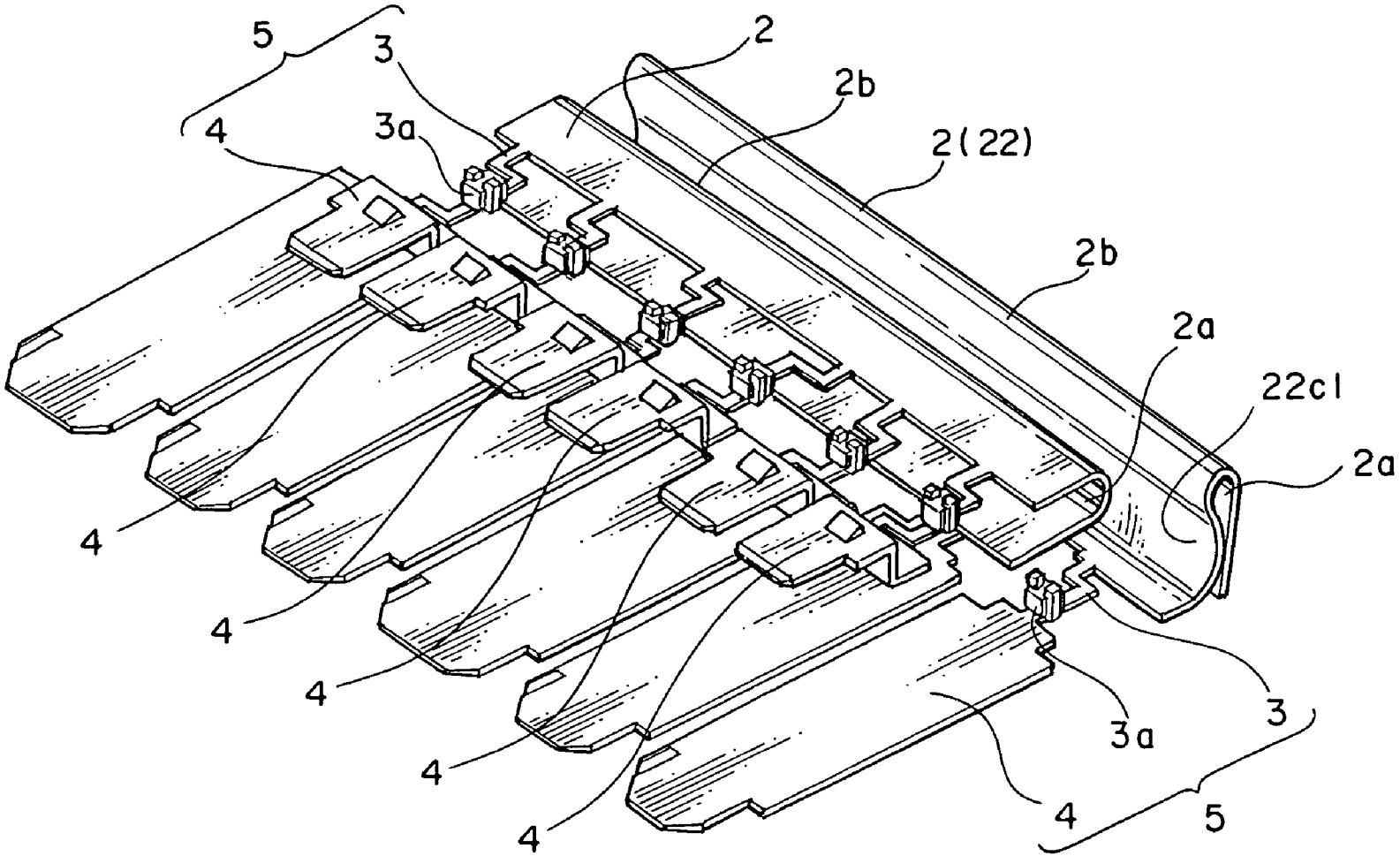
FIG. 6 is a perspective view showing a fuse circuit body of the fusible link unit shown in FIG. 5.

One coupling plate 22 of a lower fuse circuit body 6 shown in a lower part of FIG. 5 integrally includes a parallel plate 22*d* extending from the fuse elements 3 and parallel to surfaces of the fuse elements 3 and the terminals 4, and a crossing plate 22*c*1 extending from the parallel plate 22*d* and cross to the surfaces of the fuse elements 3 and the terminals 4.

As shown in FIG. 5, the crossing plate 22*c*1 is connected to the fuse elements 3 in a direction crossing the fuse elements 3. A section of the crossing plate 22*c*1 is formed in a concave shape in a direction away from the fuse elements 3. A surface of the crossing plate 22*c*1 is a mirror surface formed by such as rolling, metal plating, or the like. The crossing plate 22*c*1 collects light transmitted into the housing 7 via the opening 7*a* to the fuse elements 3. The crossing plate 22*c*1 is a reflecting wall in claims.

In the fusible link unit 1B, because the crossing plate 22*c*1 is formed in a concave shape in a direction away from the fuse elements 3, the crossing plate 22*c*1 can collect the light transmitted into the housing 7 via the opening 7*a* to the fuse elements 3. Therefore, the lower fuse elements 3 in the housing 7 are illuminated and visible via the opening 7*a*.

Further, when the fuse circuit body 6 received in the housing 7 is seen from the top of the housing via the cover 8B, the crossing plate 22*c*1 reflects a reflected image of the fuse elements 3 to the opening 7*a* so that the fuse elements 3 becomes visible.

Further, the crossing plate 22*c*1 reflects heat emission caused by the excessive current through the fuse elements 3, so that temperature of the fuse circuit body 6 is prevented from increasing.

Further, because a surface of the crossing plate 22*c*1 is a mirror surface formed by such as rolling or metal plating, the reflected image of the fuse elements 3 reflected to the opening 7*a* is clearly visible.

Third Embodiment

Next, a fusible link unit 1C according to a third embodiment of the present invention will be explained with reference to FIGS. 7 and 8.

Figure 7:
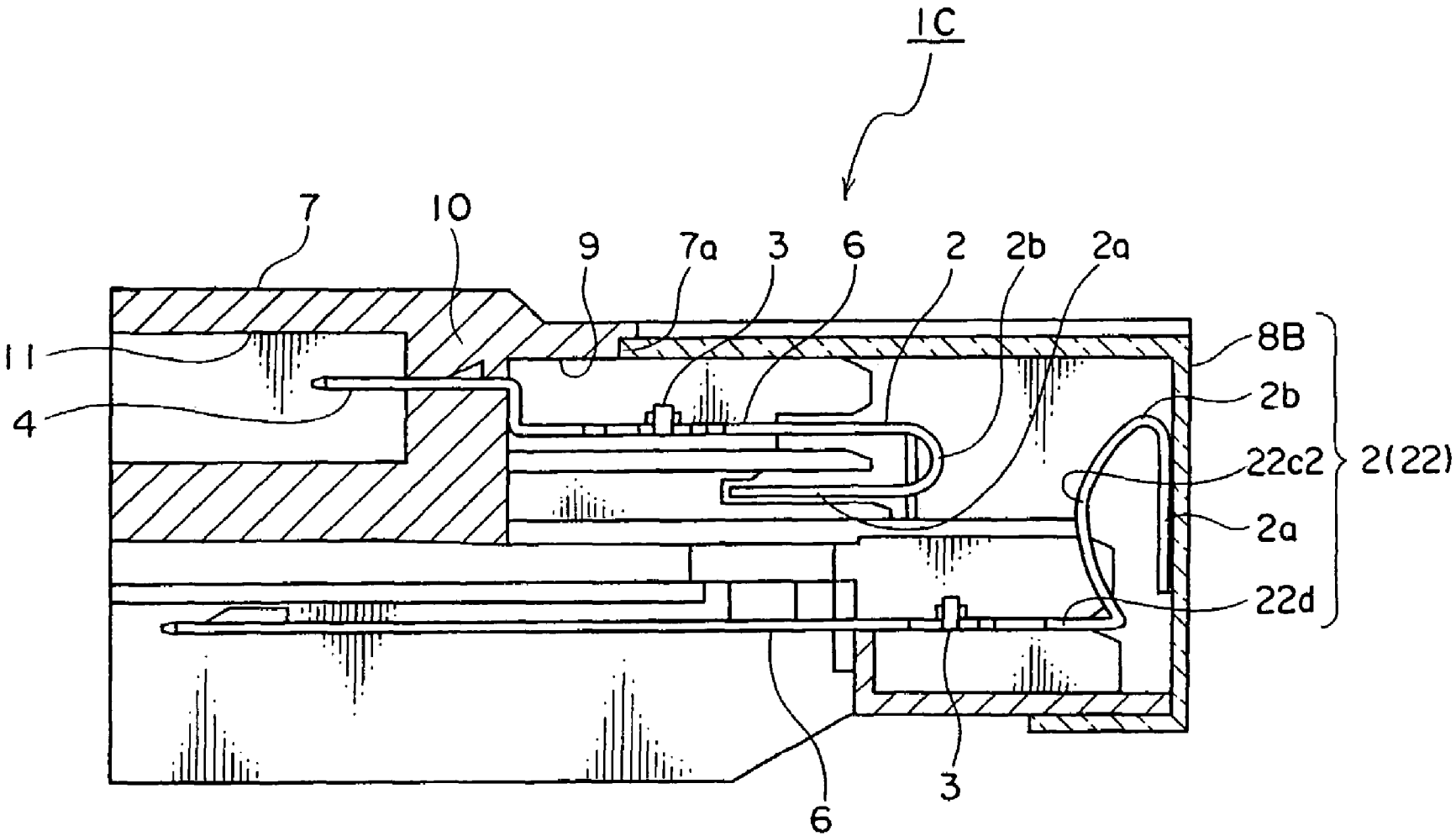
FIG. 7 is a perspective view showing a fusible link unit according to a third embodiment of the present invention.

As shown in FIG. 7, the fusible link unit 1C includes: an opening 7*a* on an outer wall thereof; a cover 8B having a U-shaped section for covering the opening 7*a*; a coupling plate 2; fuse elements 3 connected to the coupling plate 2; and terminals 4 connected to the fuse elements 3. A fuse circuit body 6 is formed by the terminals 4 connected to the coupling plate 2 via the fuse elements 3. The fusible link unit 1C further includes a housing 7 for receiving two fuse circuit bodies 6 overlapped with each other in a thickness direction of the housing 7.

Figure 8:
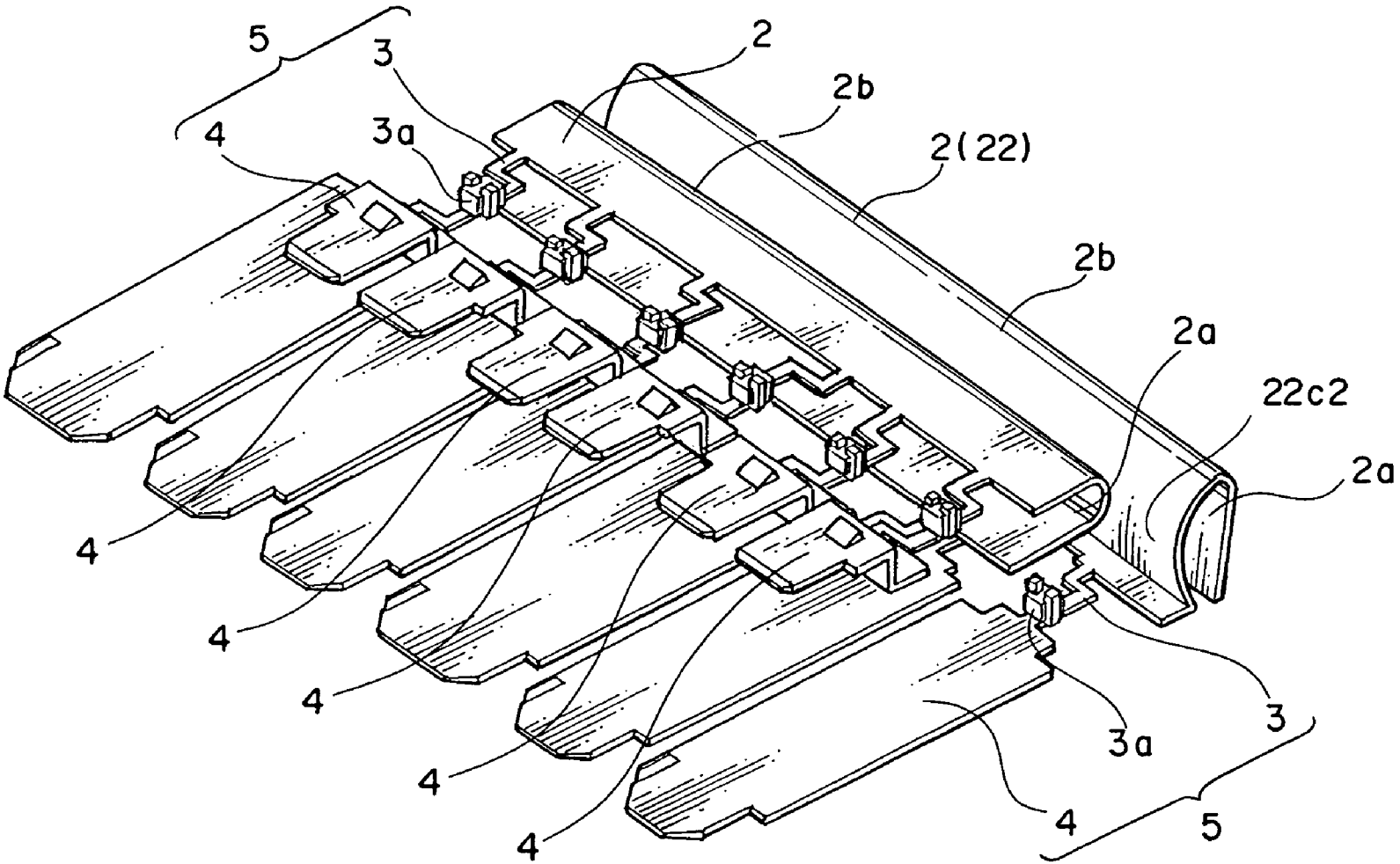
FIG. 8 is perspective view showing a fuse circuit body of the fusible link unit shown in FIG. 7.

As shown in FIGS. 7 and 8, a crossing plate 22*c*2 of a lower fuse circuit body 6 is connected to the fuse elements 3 of the coupling plate 2(22) in a direction crossing the fuse elements 3. The crossing plate 22*c*2 has a convex shaped section in a direction approaching the fuse elements 3. A surface of the crossing plate 22*c*2 is a mirror surface formed by rolling, metal plating or the like. The crossing plate 22*c*2 reflects light transmitted into the housing 7 via the opening 7*a*, and the light is diffused toward the fuse elements 3. The crossing plate 22*c*2 is a reflecting wall in claims.

According to the fusible link unit 1C, because the section of the crossing plate 22*c*2 received in the housing 7 is formed in a convex shape in the direction approaching the fuse elements 3, the light transmitted into the housing 7 via the opening 7*a* is diffused toward the fuse elements 3. Therefore, the fuse elements 3 in the housing 7 are illuminated, and a large area in the housing 7 is illuminated, so that the fuse elements 3 become visible.

Further, when the fuse circuit body 6 received in the housing 7 is seen from a top of the housing 7 via the cover 8*a*, the crossing plate 22*c*2 enlarges a reflected image of the fuse elements 3 at the center of a convex part and reflects toward the opening 7*a*, so that the fuse elements 3 becomes visible.

Further, because a surface of the crossing plate 22*c*2 is a mirror surface formed by such as rolling or metal plating, the reflected image of the fuse elements 3 reflected to the opening 7*a* is clearly visible.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fusible link unit comprising:

two fuse circuit bodies, each having a plurality of terminals connected to a coupling plate via fuse elements;

a housing having an opening at an outer wall and receiving the fuse circuit bodies and a transparent cover over the opening, the two fuse circuit bodies being overlapped with each other in a thickness direction of the housing; and a reflecting wall disposed in the housing arranged to reflect light transmitted from the opening through the transparent cover into the housing toward the fuse elements, and reflect heat emission caused by excessive current through the fuse elements so the temperature of the fuse circuit bodies is prevented from increasing.

2. A fusible link unit comprising:

two fuse circuit bodies, each having a plurality of terminals connected to a coupling plate via fuse elements;

a housing having an opening at an outer wall and receiving the fuse circuit bodies and a transparent cover over the opening, the two fuse circuit bodies being overlapped with each other in a thickness direction of the housing; and a reflecting wall disposed in the housing arranged to reflect light transmitted from the opening through the transparent cover into the housing toward the fuse elements, and reflect heat emission caused by excessive current through the fuse elements so the temperature of the fuse circuit bodies is prevented from increasing, wherein the reflecting wall is a part of the coupling plate and is formed in a shape of a concavely curved surface in a direction leaving the terminals with respect to the coupling plate.

3. A fusible link unit comprising:

two fuse circuit bodies, each having a plurality of terminals connected to a coupling plate via fuse elements;

a housing having an opening at an outer wall and receiving the fuse circuit bodies and a transparent cover over the opening, the two fuse circuit bodies being overlapped with each other in a thickness direction of the housing; and a reflecting wall disposed in the housing arranged to reflect light transmitted from the opening through the transparent cover into the housing toward the fuse elements, and reflect heat emission caused by excessive current through the fuse elements so the temperature of the fuse circuit bodies is prevented from increasing, wherein the reflecting wall is a part of the coupling plate, and is formed in a shape of a convexly curved surface in a direction approaching the terminals with respect to the coupling plate.

4. The fusible link unit as claimed in claim 2, wherein the reflecting wall is connected to the fuse elements in a direction crossing the fuse elements.

5. The fusible link unit as claimed in claim 3, wherein the reflecting wall is connected to the fuse elements in a direction crossing the fuse elements.

6. The fusible link unit as claimed in claim 1, wherein the fusible link unit is made of a transparent material, and includes the transparent cover covering the opening of the housing.

7. A fusible link unit as claimed in claim 1, wherein the reflecting wall is a sloping wall formed in a projection that is formed integrally with the transparent cover, and the sloping wall reflects a reflected image of the fuse elements toward the opening.

* * * * *